US006189805B1

(12) United States Patent
West et al.

(10) Patent No.: US 6,189,805 B1
(45) **Date of Patent: *Feb. 20, 2001**

(54) AUTOMATIC PORTABLE MISTING DEVICE

(76) Inventors: Scott West, 1316 W. Devonshire St.; Jason West, 1425 W. 6th St., both of Mesa, AZ (US) 85201

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/160,070

(22) Filed: Sep. 24, 1998

(51) Int. Cl.[7] ..... B05B 9/08

(52) U.S. Cl. ..... 239/74; 239/152; 239/373; 239/532; 239/566

(58) Field of Search ..... 239/351, 152–159, 239/566, 532, 337, 373, 74

(56) References Cited

U.S. PATENT DOCUMENTS

| | | | | |
|---|---|---|---|---|
| 384,630 | * | 6/1888 | Koechlin | 239/351 X |
| 2,705,171 | * | 3/1955 | Ziherl | 239/351 X |
| 3,142,443 | * | 7/1964 | Morgan | 239/373 X |
| 3,727,841 | * | 4/1973 | Hengesbach | 239/532 X |
| 4,298,166 | * | 11/1981 | White et al. | 239/566 X |
| 4,702,416 | * | 10/1987 | Pagliai et al. | 239/154 X |
| 4,899,940 | * | 2/1990 | Leaver | 239/532 |
| 5,121,882 | | 6/1992 | Skidmore . | |
| 5,273,214 | | 12/1993 | Huffstutler . | |
| 5,330,104 | | 7/1994 | Marcus . | |
| 5,335,853 | * | 8/1994 | Wirz | 239/154 X |
| 5,409,167 | * | 4/1995 | Borod | 239/351 X |
| 5,535,951 | | 7/1996 | Utter . | |
| 5,775,590 | * | 7/1998 | Utter | 239/373 X |

* cited by examiner

*Primary Examiner*—Kevin Weldon
(74) *Attorney, Agent, or Firm*—Snell & Wilmer L.L.P.

(57) ABSTRACT

The present invention includes an automatic portable misting apparatus for providing a comfortable region within a relatively hot, dry environment. The misting apparatus includes a pressurizable fluid tank, an automatic air compressor mounted to the fluid tank, a fluid conduit having a plurality of nozzles spaced at intervals along the conduit for distributing water in the form of a corresponding number of fine spray streams, and a valve for controlling the flow of fluid from the fluid tank to the fluid conduit. The misting apparatus of the present invention is fully portable, easy to operate, easy to maintain, unobtrusive and economical.

15 Claims, 1 Drawing Sheet

AUTOMATIC PORTABLE MISTING DEVICE

FIELD OF THE INVENTION

This invention generally relates to misting devices, and more particularly, to an automatic, portable and compact misting device for delivering a fine spray or mist for evaporatively or conductively cooling a localized area.

BACKGROUND OF THE INVENTION

It is a well-known principle that water evaporation is particularly effective as a coolant when the ambient air has low humidity. It is also well-known that comfort levels are enhanced in extremely dry environments by elevating the relative humidity to moderately dry. An apparatus which utilizes this evaporative cooling principle in an easy-to-use, portable and efficient manner is needed.

Sufficient automatic portable misting devices for delivering humidity into a dry atmosphere to lower the ambient atmospheric temperature in a localized area or to lower the surface temperature of a person's skin are not available. A variety of devices for directing and applying a spray or mist of fluid to an object, such as crops, lawns, weeds or fire are known. Misting devices such as those associated with greenhouse agriculture have long been used for air conditioning of outdoor environments. In fact, some of these devices have been adapted and have become popular for use by sunbathers, athletes, and others participating in outdoor activities in hot, arid climates. However, the misting devices of the prior art exhibit various disadvantages. Many prior art devices are ineffective in that they do not provide a desired uniformity and coverage of the misting, or are difficult to use because the misting nozzles are difficult to support in desired locations. Likewise, many of the prior art devices are unsuitable for use in many remote outdoor locations because they require a pressurized water source and are awkward to relocate and to store when not in use. In addition, many of the prior art devices utilize expensive, high-maintenance pumps that require a non-portable source of electric power.

Thus, there is a need for a misting apparatus for outdoor environments that is portable, easy to use and to store, unobtrusive, and effective for uniformly misting a localized area. Accordingly, it is desirable that the misting apparatus be portable for ready transportation to a variety of outdoor locations, such as a yard, a beach, a boat, a campground or the like, and be adaptable for use by one or more persons. It is also desirable that the quantity of water dispensed be controllable to maintain comfort during outdoor activities and that the apparatus be economical to purchase and to operate.

An examination of the spraying apparatus art clearly discloses that containers for the fluid are pressurized by either motor powered pumps, air pressure directly applied to the fluid chamber, or manual pumping. Examples of motor powered sprayers are represented in U.S. Pat. No. 3,421,697 Nov. 10, 1970, U.S. Pat. No. 4,651,903 issued to Pagliai on Mar. 24, 1987. Examples of air pressurized and manually powered sprayers are represented in U.S. Pat. No. 2,911,157 issued to De Coste on Nov. 14, 1967, U.S. Pat. No. 3,993,245 issued to Smith on Nov. 23, 1976, and U.S. Pat. No. 4,688,643 issued to Carter et al. on Apr. 25, 1987. The motor powered sprayers are often heavy, noisy, cumbersome to use, expensive to maintain and require either fuel or an electrical cord connecting the sprayer to an electrical source, both of which may not be readily available in an outdoor environment. The air pressurized sprayers of the prior art typically require that the user has constant access to a source of pressurized air to recharge the container, while the manually pumped containers often provide limited pressurization and require manual effort to pressurize.

Therefore, a need exists for a portable mist cooling apparatus for evaporatively or conductively cooling a localized area which employs a refillable, pressurizable tank, an automatic pressurizing means, such as a portable air compressor, a fluid conduit having a plurality of longitudinally-spaced openings therein for distributing a fine spray or mist, and a valve for activating a flow of pressurized fluid from the tank through the fluid conduit.

SUMMARY OF THE INVENTION

The present invention generally includes a portable apparatus which delivers a fine spray or mist for the comfortable and efficient outdoor cooling of one or more persons. In accordance with a preferred embodiment of the present invention, an apparatus for delivering a mist of water generally includes a pressurizable fluid tank, a means for pressurizing the fluid tank, such as a compressor, and a fluid conduit in fluid communication with the fluid tank having a plurality of openings therein spaced longitudinally along the conduit for distributing water in the form of a corresponding number of fine spray streams.

The flow of water through the fluid conduit is preferably controlled by a valve which is located at the inlet to the conduit. The closed distal end of the conduit seals the conduit and forces water flowing into the conduit through the openings or nozzles, thereby generating a fine spray or mist. The entire apparatus is compact and economical because, in a preferred embodiment of the present invention, a flexible fluid conduit enables the mister apparatus to be easily folded for transportation or storage.

BRIEF DESCRIPTION OF THE DRAWINGS

Preferred exemplary embodiments of the present invention will hereinafter be described in conjunction with the appended drawing figures, wherein like numerals denote like elements and.

DETAILED DESCRIPTION OF THE PREFERRED EXEMPLARY EMBODIMENTS

Figure 1:
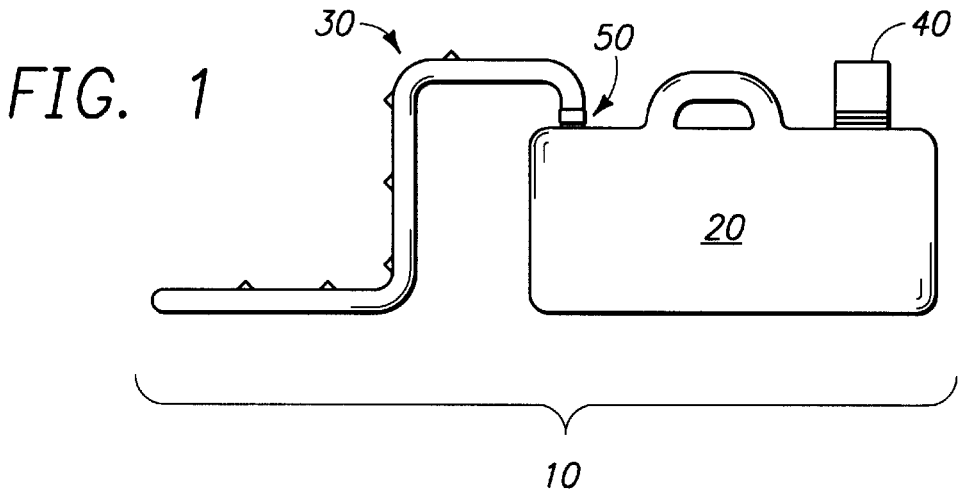
FIG. 1 shows an exemplary misting apparatus in accordance with a preferred embodiment of the present invention.

With reference to the accompanying Figures, the present invention generally includes a portable apparatus which delivers a fine spray or mist for the comfortable and efficient outdoor cooling of an area. Portable misting device 10 preferably comprises, with particular reference to FIG. 1, a pressurizable fluid tank 20, a fluid conduit 30, an automatic air compressor 40, and a valve 50.

Figure 2:
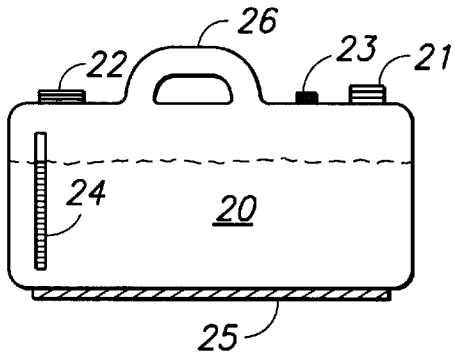
FIG. 2 shows an exemplary pressurizable fluid tank in accordance with the apparatus of FIG. 1; and, FIG. 3 shows an exemplary fluid conduit in accordance with the apparatus of FIG. 1.

In FIG. 2, the pressurizable fluid tank 20 preferably has at least two openings or one opening which is divisible into two points of entry. A first opening 21 configured to couple with the pressurizing means 40, such as a compact air compressor, and a second opening 22 is configured to couple with the fluid conduit 30. One skilled in the art will appreciate that the openings can be at any suitable location on the fluid tank 20; however, the openings are preferably located at the top of the fluid tank 20. In a preferred embodiment of the present invention, fluid tank 20 includes a third opening 23 which allows easy refill of the tank without removing either the pressurizing means 40 or the fluid conduit 30. The first opening 21 and second opening 22 are preferably threaded to allow quick, air-tight coupling and de-coupling of the pressurizing means 40 and fluid conduit 30, respectively, to fluid tank 20. The third opening 23 may be threaded to accommodate a threaded plug or may be non-threaded and capped; however, all seals are preferably air-tight when the misting device is in operation. One skilled in the art will appreciate that any suitable coupling can be used to connect the fluid conduit 30 and the pressurizing means 40 to the fluid tank.

To facilitate transport, the fluid tank 20 preferably includes carrying means, such as a rigid or pliable handle, a strap, a harness, or the like. In one preferred embodiment, a prefabricated fluid tank includes a rigid handle 26 disposed at the top of the tank. In another embodiment, prefabricated fluid tanks that comprise wheels or rollers that increase portability of the misting device are suitable for use in the present invention.

Fluid tank 20 may be constructed from a variety of materials, including plastics, polymers, metals and metal alloys. Lightweight, durable materials, such as polytetrafluroethylene (PTFE), are most preferred. Prefabricated fluid tanks which can be adapted for use in the present invention are readily available at a variety of retail outlets.

Alternatively, fluid tank 20 includes a level indicator means 24, such as a transparent window or external gauge, to indicate to the user when refill of the fluid tank is necessary. Many readily-available prefabricated fluid tanks include transparent windows that serve this purpose or a level indicator can be incorporated into the tank.

The fluid tank 20 alternatively includes a cleated or otherwise corrugated base 25 to increase stability and decrease sliding of the misting device 10 when used on inclines or in vehicles, such as boats. Another embodiment of the fluid tank 20 includes a hook or other device for securing fluid conduit 30 to the fluid tank when not in use for convenient storage and transport.

Figure 3:
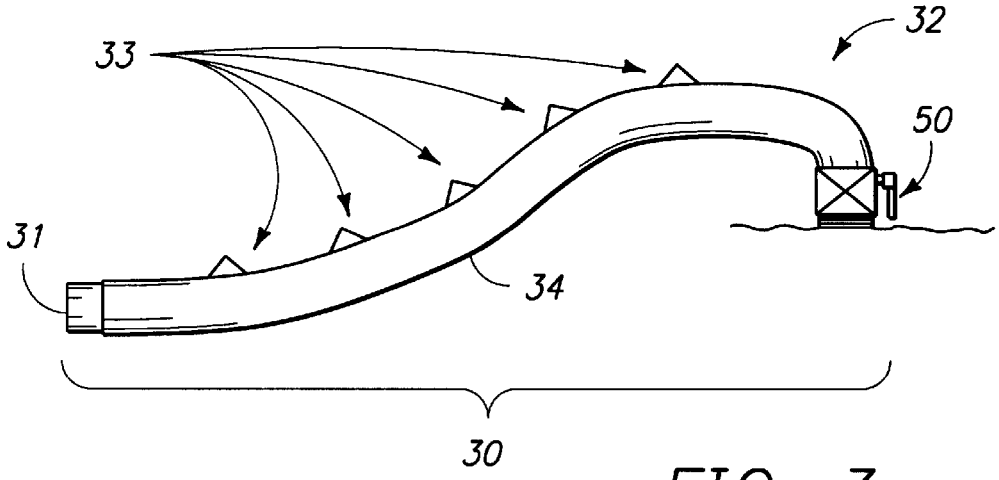

In FIG. 3, the fluid conduit 30 preferably comprises a length of tubing 34, either flexible or rigid, having a distal end 31 and a proximal end 32. The proximal end 32 is connected to the fluid tank 20 and the distal end 31 is closed or capped to terminate fluid flow at the distal end of the conduit 30. The fluid conduit 30 preferably includes one or more holes or nozzles 33 spaced along the conduit for distributing fluid in the form of, for example, fine spray streams when fluid from the pressurized fluid tank 20 is forced through the fluid conduit 30. In a preferred embodiment of the present invention, the fluid conduit 30 comprises a plurality of nozzles 33 suitably spaced longitudinally along a flexible conduit 34 so as to generate a fine mist during operation. In a most preferred embodiment, the fluid conduit 30 comprises from about six to about twelve nozzles equally spaced along the conduit.

The fluid conduit 30 may be of any diameter or length suitable to achieve the objectives of the invention. The pressure output of the pressurizing means 40 and the volume of the fluid tank 20 will necessarily limit the diameter and length of the fluid conduit 30, as well as the number of holes or nozzles in the fluid conduit. The fluid conduit and nozzles are readily available at any plumbing supply or hardware store. In a preferred embodiment, at least one MINI-MIST® portable cooling system kit manufactured by Arizona Mist, Inc., part no. 20060-20, is used. Each kit contains UV-resistant ¼ inch flexible tubing, brass and stainless steel mist nozzles, hanging snap clips, a hose adaptor and an end cap. The kit attaches securely to the fluid tank and the nozzles are adjustable to easily change the direction of spray. Multiple kits may be connected in series to provide additional cooling capacity.

The pressurizing means 40 is any suitable device configured to increase pressure inside the fluid tank 20, such as a compact air compressor, a manual air pump, and/or the like. In a preferred embodiment of the present invention, an automatic, compact air compressor is employed to pressurize the fluid tank 20. The air compressor base is preferably suitably threaded to attach securely to the first opening 21 in the fluid tank 20 and to form an airtight seal. In a preferred embodiment, the air compressor comprises a BLACK & DECKER® 7.2 Volt VERSAPAK™ multi-purpose cordless inflator with a modified plastic casing that allows air-tight threaded attachment of the compressor to the first opening 21 of the fluid tank 20. The VERSAPAK™ cordless inflator comprises a rechargeable nickel-cadmium battery pack as described in the Instruction Manual accompanying the device, which is hereby incorporated by reference. The preferred air compressor is lightweight and durable, as well as inexpensive and easy to maintain.

The pressurizing means 40 preferably includes a power source and a power switch. The power source is any suitable device configured to supply power to the compressor, such as a battery, a rechargeable battery, AC electric power, a solar cell, a fuel-powered generator, and/or the like. In a preferred embodiment, the air compressor 60 includes both a rechargeable battery pack and an AC adapter configured for use with an automobile auxiliary power outlet.

The pressurizing means 40 is preferably automatically controlled such that when the pressure inside the fluid tank 20 reaches a predetermined lower-limit value, such as about 25 psi, the pressurizing means 40 is brought into a load-running state to supply compressed air to the fluid tank 20. When the pressure inside the fluid tank 20 reaches a predetermined upper-limit value, such as about 45 psi, the pressurizing means 40 is brought into a stand-by state to suspend the supply of compressed air to the fluid tank 20. Automatic control of the pressurizing means 40 ensures safe and steady operation of the misting device 10 without the need for substantial user supervision or manual control.

In operation, water, or any preferable liquid or gas, is poured into the fluid tank 20 through the second opening 22 and the pressurizing means 40 is securely attached over the first opening 21. The fluid conduit 30 is securely attached over the second opening 22. If a fluid tank 20 comprising three openings is used, the third opening 23 may be used to fill and re-fill the fluid tank 20, so that the fluid conduit 30 may remain attached over the second opening 22. The pressurizing means 40 is activated at the switch and air fills the remaining space inside the fluid tank 20, thereby increasing the fluid tank pressure. Water from the pressurized fluid tank 20 then enters the inlet of the fluid conduit 30 through a valve 50, flowing until it reaches the closed distal end 31 of the fluid conduit. The water, being restricted from flowing further, is thereby forced through the openings 33 in the fluid conduit 34 to generate a fine mist. The rate of flow of water is controlled by valve 50 and that flow rate determines the volume and range of spray or mist produced. Valve 50 is preferably of a type which permits a gradual variation of flow between a full flow "ON" position and a no flow "OFF" position.

Other features of the fluid conduit 30 may make the assembly adaptable to a variety of outdoor uses. For example, a plurality of small hooks, clips, or hook-loop (Velcro®) fasteners may be spaced at intervals along the length of the fluid conduit 30 to enable the conduit to be securely mounted to a structure such as a tent, a chair, a canopy, a watercraft railing, or a tree. In addition, a quick-coupling assembly may be employed between the fluid conduit 30 and the fluid tank 20 to further facilitate assembly and disassembly of the misting device 10 for convenient storage and transport. For example, a ½ inch "cam & groove" coupling of the type commercially provided for connecting fire hoses may be utilized with the fluid conduit 30 employed in a preferred embodiment.

It has been found that a variety of commercially available nozzles are suitable for producing the very fine mist desired by the presently preferred embodiment. Furthermore, it has been found that a flow rate of 0.5 gallons per hour through each nozzle is suitable for producing this fine mist. Although these features are desirable, it should be understood that any flow rate, pipe diameter, and nozzle combination which produces a suitable fine water mist could be utilized in accordance with the present invention.

The apparatus of the present invention may be constructed of a variety of different materials. However, the materials are suitably selected to account for the stresses to which the apparatus will be subjected during operation, such as water, heat, rugged transport, and direct sunlight.

Although the present invention has been described in considerable detail with reference to certain preferred embodiments, alternative embodiments are possible. Therefore, the spirit and scope of the appended claims should not be limited to the description of the preferred embodiments of the invention contained herein.

We claim:

1. A misting apparatus comprising:

(a) a portable, pressurizable fluid tank;

(b) an automatic, continuous, Portable pressurizing device removably coupled to said fluid tank, said pressurizing device providing air pressure inside said fluid tank, said pressurizing device configured to, upon a single action, provide continuous, uninterrupted pressure inside said fluid tank; and, (c) an extended fluid conduit configured to be placed across a wide area, the conduit having a distal end and a proximal end, the proximal end in fluid communication with the fluid tank and the distal end restricted, the conduit further comprising a plurality of holes widely spaced along the conduit, said conduit configured, while in a stationary position, to widely and continuously distribute water over a large area in the form of a corresponding number of fine spray streams when fluid is communicated to the conduit.

2. The misting apparatus of claim 1, wherein the fluid conduit includes between about 6 and about 12 holes spaced longitudinally along the fluid conduit.

3. The misting apparatus of claim 1 further comprising a valve coupled between the fluid tank and the fluid conduit for controlling flow of fluid through the conduit.

4. The misting apparatus of claim 1, wherein the fluid conduit is substantially rigid.

5. The misting apparatus of claim 1, wherein the fluid conduit comprises a flexible hose.

6. The misting apparatus of claim 1, wherein the pressurizing means is a compressor.

7. The misting apparatus of claim 6, wherein the compressor power source is selected from the group consisting of a battery, a rechargeable battery, AC electric power, a solar cell, and a fuel-burning generator.

8. The misting apparatus of claim 6, wherein the output of the compressor is from about 25 to about 45 psi.

9. The misting apparatus of claim 1, wherein the pressurizable fluid tank has a volume of greater than about 5 gallons.

10. The misting apparatus of claim 1, wherein the pressurizable fluid tank is made of plastic.

11. The misting apparatus of claim 1, wherein the pressurizable fluid tank includes carrying means.

12. The misting apparatus of claim 11, wherein the carrying means is selected from the group consisting of a handle, a strap, and a harness.

13. The misting apparatus of claim 1, wherein the fluid tank further includes a fluid level indicator.

14. The misting apparatus of claim 1, further comprising a quick coupling connector between the fluid tank and the fluid conduit.

15. A method for continuously delivering a fine spray or mist over a wide area comprising:

(a) providing a portable, pressurizable fluid tank;

(b) upon a single action, continuously and automatically providing uninterrupted pressure to said fluid tank using a portable pressurizing device removably coupled to said fluid tank;

(c) forcing pressurized fluid from said fluid tank through an extended fluid conduit in fluid communication with the fluid tank, said fluid conduit having a distal end and a proximal end, the proximal end in fluid communication with the fluid tank and the distal end restricted;

(d) placing said fluid conduit across a wide area;

(e) continuously distributing water over a large area while said conduit is in a stationary position, wherein the conduit comprises a plurality of widely spaced holes corresponding to number of fine spray streams.

* * * * *